US010760783B2

(12) United States Patent
Reynolds

(10) Patent No.: US 10,760,783 B2
(45) Date of Patent: Sep. 1, 2020

(54) TABLE WITH ATTACHED LAMP AND EMBEDDED TOUCH CONTROLS

(71) Applicant: Margaux Reynolds, Studio City, CA (US)

(72) Inventor: Margaux Reynolds, Studio City, CA (US)

( * ) Notice: Subject to any disclaimer, the term of this patent is extended or adjusted under 35 U.S.C. 154(b) by 125 days.

(21) Appl. No.: 15/954,505

(22) Filed: Apr. 16, 2018

(65) Prior Publication Data

US 2018/0231235 A1 Aug. 16, 2018

Related U.S. Application Data

(63) Continuation-in-part of application No. 15/374,954, filed on Dec. 9, 2016, now abandoned.

(Continued)

(51) Int. Cl.

| | |
|---|---|
| ***F21V 33/00*** | (2006.01) |
| ***F21K 9/20*** | (2016.01) |
| ***F21V 23/00*** | (2015.01) |
| ***A47B 13/16*** | (2006.01) |
| ***F21S 8/00*** | (2006.01) |
| ***F21V 21/26*** | (2006.01) |
| ***F21Y 115/10*** | (2016.01) |

(Continued)

(52) U.S. Cl.

CPC ..... *F21V 33/0012* (2013.01); *A47B 13/16* (2013.01); *F21K 9/20* (2016.08); *F21S 8/03* (2013.01); *F21V 23/005* (2013.01); *F21S 2/00* (2013.01); *F21V 21/26* (2013.01); *F21V 23/0485* (2013.01); *F21Y 2115/10* (2016.08)

(58) Field of Classification Search

CPC ..... F21V 33/0012; F21V 33/0024; F21V 33/0048; F21V 33/0068; F21V 21/26; F21V 21/28; F21V 21/29; F21V 21/30; F21V 21/22; A47B 13/16; A47B 2220/0075; A47B 2220/0077

See application file for complete search history.

(56) References Cited

U.S. PATENT DOCUMENTS

| | | | |
|---|---|---|---|
| 2,218,395 | A | 10/1940 | Hallbauer |
| 6,595,654 | B2 | 7/2003 | Washburn |

(Continued)

FOREIGN PATENT DOCUMENTS

| | | | |
|---|---|---|---|
| EP | 2446787 | A1 | 5/2012 |

OTHER PUBLICATIONS

GOgroove BlueSYNC Tym Real Wood Bluetooth Speaker & Alarm Clock—Light, Ebay item, Sep. 9, 2015, 3 pages, retrieved from the internet: http://www.ebay.com/itm/like/351384493897?lpid=82.

*Primary Examiner* — Alexander K Garlen
*Assistant Examiner* — Colin J Cattanach
(74) *Attorney, Agent, or Firm* — Loza & Loza, LLP; Michael F. Fedrick

(57) ABSTRACT

A table that includes a planar upper surface having a recess, a lamp positioned in the recess, a first sensor, and an embedded touch control. The lamp can be in a closed position or an open position, and have a first section and a second section. The first section is attached to the planar upper surface at a proximal end thereof. The first sensor detects the position of the lamp and communicates with circuitry to activate and deactivate lamp based on the position of the lamp. The embedded touch control is located beneath the planar upper surface and controls the light level of the lamp.

19 Claims, 16 Drawing Sheets

Related U.S. Application Data

(60) Provisional application No. 62/265,400, filed on Dec. 9, 2015.

(51) Int. Cl.
*F21S 2/00* (2016.01)
*F21V 23/04* (2006.01)

(56) References Cited

U.S. PATENT DOCUMENTS 7,798,682 B1 9/2010 Cvek
8,522,695 B2 9/2013 Ellegaard
9,366,420 B2 * 6/2016 Kasuga ..... F21V 23/003
2005/0082989 A1 * 4/2005 Jones ..... F21L 4/00 315/194
2006/0160485 A1 7/2006 Brake et al.
2009/0058118 A1 * 3/2009 Hein ..... B60K 35/00 296/1.08
2009/0141495 A1 * 6/2009 Lin ..... F21V 21/22 362/253
2009/0161365 A1 6/2009 Ono et al.
2011/0051437 A1 3/2011 Ng et al.
2011/0228538 A1 * 9/2011 Yu ..... F21V 21/30 362/287
2012/0069444 A1 * 3/2012 Campbell ..... B60R 1/12 359/630
2012/0314418 A1 * 12/2012 Byrne ..... F21V 21/22 362/285
2013/0163232 A1 * 6/2013 Kasuga ..... F21V 23/003 362/127
2013/0249568 A1 9/2013 Botten
2014/0246300 A1 * 9/2014 Wende ..... H03K 17/962 200/600
2015/0331444 A1 * 11/2015 Rappoport ..... G06F 1/1601 362/249.02
2016/0084486 A1 * 3/2016 Chen ..... F21S 6/003 362/612
2016/0350818 A1 * 12/2016 Saeed ..... G06Q 30/0282
2017/0227234 A1 * 8/2017 Yamazaki ..... C03C 17/22

* cited by examiner

TABLE WITH ATTACHED LAMP AND EMBEDDED TOUCH CONTROLS

CROSS-REFERENCE TO RELATED APPLICATIONS

This application is a continuation-in-part of, and claims the benefit of priority under 35 U.S.C. § 120 from, U.S. patent application Ser. No. 15/374,954, filed Dec. 9, 2016 and entitled TABLE WITH ATTACHED LIGHT AND EMBEDDED CONTROLS, which is a non-provisional patent application claiming the benefit of priority under 35 U.S.C. § 120 from U.S. Patent Application No. 62/265,400, filed Dec. 9, 2015. The disclosures of the foregoing patent applications are incorporated herein by reference in their entirety.

BACKGROUND

A variety of furniture has been designed to incorporate electric lighting. The functionality of furniture intended to facilitate reading and writing, such as desks and tables, can be particularly enhanced through the addition of artificial lighting, in order to allow the furniture to be better used at night or in low-light surroundings. An example of an electric light secured to a desk or table can be seen, for example, in US Patent Publication No. US20130163232 to Hirofumi Kasuga.

Furniture which incorporates sensors for controlling an electrical device is also known. For example, the cabinet described in US Patent Publication No. 20130249568 includes illuminated touch controls. Airline furniture as described in US Patent Publication No. 20140246300 has also been designed to include electronic switches. There remains a need, however, for improved furniture designs which incorporate lighting.

SUMMARY

The present invention comprises a table top and built in lamp for providing lighting to a user. The table top has a planar upper surface, a lower surface, and a recess in the planar upper surface. A lamp having a proximal end and a distal end is positioned in the recess such that the upper surface of the lamp is co-planar with the planar upper surface of the table top when the lamp is in the closed position. The proximal end of the lamp is connected to the table top so as to allow articulation of the distal end of the lamp with respect to the table top. Preferably, the lamp is connected to the table top with a hinge and is rotatable around the hinge between a closed position, in which lower surface of the lamp faces the upper surface of the recess, and an open position in which the lamp is disposed at an angle with respect to the planar upper surface of the table top. The lamp comprises a light source which is able to emit light when placed in communication with a source of electricity. The present table top further includes a first sensor that detects whether the lamp is in the open position or in the closed position, the first sensor being located adjacent to the recess and/or the lamp. The first sensor can be, for example, a Hall effect sensor, a Reed switch, or a dead man's switch.

An embedded touch control that controls the light level of the lamp is provided in the present table beneath the planar upper surface of the table top. The touch control comprises a capacitive touch sensor having a conductive layer and an indicator light, the indicator light being positioned beneath and spaced apart from the conductive layer of the touch sensor. The conductive layer can be metal, and the indicator light preferably comprises one or more LEDs. The first sensor, the touch control, and the lamp are in electrical communication with control circuitry which controls a light level of the lamp in response to a signal received from the touch sensor. In the table top, light from the indicator light is able to pass through a translucent portion of the planar upper surface above the touch control and form indicia, and when the lamp is placed in the open position, the indicator light is activated and emits light, but when the lamp is in the closed position, the indicator light does not emit light.

In one embodiment, the touch control activates and deactivates the lamp. Alternatively, the lamp can turn on automatically when the first sensor detects that the lamp is in the open position. The touch control also preferably changes a light level of the lamp. The lamp can include a proximal section and a distal section, and in preferred embodiments the distal section of the lamp is rotatable with respect to the proximal section. The table top can be formed from a variety of materials, such as medium density fiberboard, solid laminate, wood veneer, opaque acrylic, and plastic, and can include a veneer over another substrate. The translucent portion of the planar upper surface can be formed by etching a portion of the lower surface of the table top, such as to a depth of between 0.1 millimeter and 1 millimeter, more preferably to a depth of between 0.2 millimeter and 5 millimeters, and even more preferably to a depth of between 0.5 millimeter and 10 millimeters.

The table top is preferably incorporated into a table that has one or more supports for the table top. The one or more supports can be vertically extending legs. In a conventional table incorporating the present table top, the table can have four legs. In other configurations, a piece of furniture incorporating the present table top can include a plurality of lamps.

FIGURES

The accompanying figures, which are included to provide a further understanding of the invention and are incorporated in and constitute a part of this specification, illustrate embodiments of the invention and together with the description serve to explain the principles of the invention.

Figure 1:
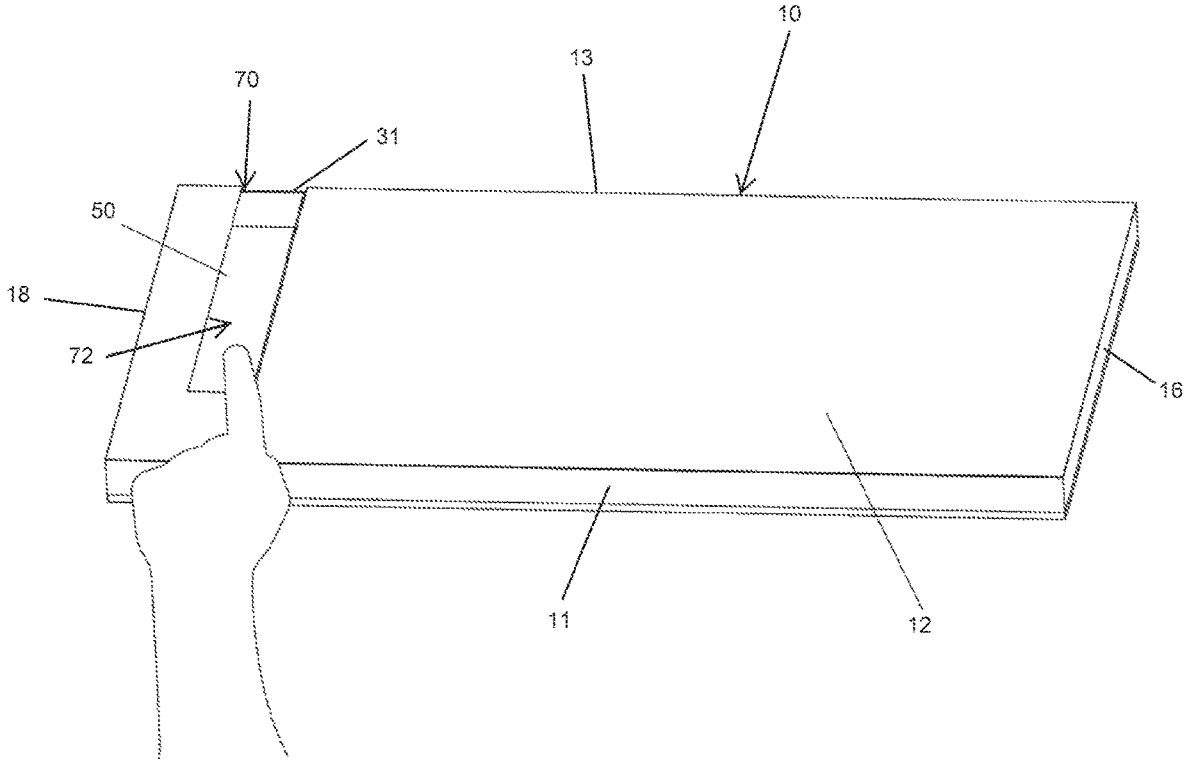
FIG. 1 is a top, left side perspective view of an embodiment of a table top of the present invention, showing the attached lamp in a closed position.

The reference numbers in the figures have the following meanings:

| Component | Reference Number |
|---|---|
| table | 1 |
| supports for the table top | 5 |
| lower cover | 9 |
| table top | 10 |
| table top planar upper surface | 12 |
| table top lower surface | 14 |
| table top front side | 11 |
| table top rear side | 13 |
| table top right side | 16 |
| table top left side | 18 |
| table top opening for recess | 15 |
| veneer | 20 |
| veneer front side | 21 |
| veneer rear side | 23 |
| veneer upper surface | 22 |
| veneer lower surface | 24 |
| veneer right side | 26 |
| veneer left side | 28 |
| recess | 30 |
| recess lower surface | 34 |
| recess front side | 31 |
| recess rear side | 33 |
| recess right side | 36 |
| recess left side | 38 |
| spring hinge | 40 |
| spring hinge first joining portion | 42 |
| spring hinge second joining portion | 44 |
| spring | 45 |
| lamp | 50 |
| lamp upper surface | 52 |
| lamp lower surface | 54 |
| lamp proximal end | 57 |
| lamp distal end | 59 |
| lamp right side | 56 |
| lamp left side | 58 |
| lamp front side | 51 |
| lamp rear side | 53 |
| latch | 55 |
| lamp proximal section | 61 |
| lamp proximal section proximal end | 62 |
| lamp proximal section distal end | 63 |
| lamp distal section | 65 |
| lamp distal section proximal end | 66 |
| lamp distal section distal end | 67 |
| lamp hinge | 70 |
| closed position | 72 |
| open position | 74 |
| channel | 73 |
| section hinge | 75 |
| light source | 80 |

-continued

| Component | Reference Number |
|---|---|
| first sensor | 90 |
| magnet | 92 |
| embedded touch control | 200 |
| sensor circuitry | 210 |
| control circuitry | 215 |
| electrical connector | 217 |
| capacitive touch sensor | 220 |
| conductive layer | 222 |
| sensor wire | 223 |
| patterned metal layer | 224 |
| indicia | 225 |
| solder point | 227 |
| lighted indicator | 240 |
| electrical wires | 260 |
| indicator light | 280 |
| LEDs | 282 |
| area of reduced thickness | 290 |

DESCRIPTION

Definitions

As used herein, the following terms and variations thereof have the meanings given below, unless a different meaning is clearly intended by the context in which such term is used.

"Below" and "under" denote the relative position of a component which is located downwardly with respect to the position of another component of the present device. "Above" and "over" denote the opposite relative position of a component, i.e. a position which is located upwardly with respect to the position of another component.

"Downward" and "downwardly" mean in the direction of or toward a floor or other surface on which the present device is placed, unless otherwise indicated. "Upward" and "upwardly" mean in the opposite direction, away from a floor or other surface.

"Elongated" refers to a configuration or shape having a length which is longer than its width.

A "hinge" is a movable joint which connects two components of the present device and allows rotation around the joint or movement with respect to the unconnected portions of the device.

"Lamp" is a device for giving light.

"Lower" refers to the relative position of a component in the present device which is closer to a floor or other surface on which the present device is placed. "Upper" refers to the relative position of a component which is further from the floor or other surface.

"Recess" refers to a portion of the present table top which extends below the planar upper surface of the table top and comprises a receptacle area for receiving the lamp portion of the table.

"Table" refers to a piece of furniture with a substantially planar upper surface which provides a rigid surface on which objects may be placed, and which is supported above a support surface such as a floor. Tables are typically supported above a support surface by one or more legs or other supports, and may include additional structural components.

"Table top" refers to the upper, generally horizontal portion of a table which includes the upper surface and which is supported above the ground or other support surface. A table top may be supported by legs and/or other structural components of a table, and may be retained in a framework in the manner of a drafting table.

"Translucent" refers to a material or substance which allows some visible light to pass through but which scatters or diffuses the light, and/or which absorbs or blocks the passage of some light. Translucent materials prevent detailed images from being seen through the material.

"Transparent" refers to a material or substance which allows sufficient visible spectrum light to pass through to allow detailed images to be seen through the material, such as clear glass or plastic.

"Veneer" refers to a thin layer of material, such as plastic or wood, overlaying a support surface. Veneers of the present table are generally between 0.1 and 10 millimeters, in order to allow a capacitance sensor to be activated by the touch of a finger and also to allow the passage of light therethrough from an indicator light.

Terms of relative position such as "upper," "lower," "top", "bottom," "front," "rear," "right," "left," and similar terms are used to designate areas and positions of portions or components of the present device with respect to other portions of components of the present device, but it is to be understood that these terms are relative and are not absolute terms. For example, "right" and "left" are used to designate opposing lateral positions.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Table with Attached Lamp

The present table 1 generally comprises a table top 10 having an attached lamp 50 and embedded touch controls 200. The table top 10 has a planar upper surface 12 and a lower surface 14, and in embodiments in which the table top 10 is square or rectangular the table top 10 further comprises a front side 11, rear side 13, right side 16, and left side 18. In a preferred embodiment, the table top 10 comprises a structural lower portion covered by a veneer 20, which then forms the planar upper surface 12. The veneer 20, when used, comprises a front side 21, rear side 23, right side 26, left side 28, upper surface 22, and lower surface 24.

The table top 10 further includes an opening 15 in the planar upper surface 12 which forms a recess 30 which extends downwardly below the planar upper surface 12 in order to be able to contain the lamp 50. When the lamp 50 has a cuboid shape, as shown in the illustrated embodiment, the lamp 50 generally comprises an upper surface 52, lower surface 54, proximal end 57, distal end 59, right side 56, left side 58, front side 51, rear side 53, proximal end 57, and distal end 59.

The lamp 50 is positioned in the recess 30 so that the planar upper surface 52 of the lamp 50 is co-planar with the planar upper surface 12 of the table top 10 when the lamp 50 is retained in the recess 30 in a closed position 72 (FIG. 1). Preferably, the planar upper surface 52 of the lamp 50 is formed from a material or veneer which is the same as that of the planar upper surface 12 of the table top 10, so that when the lamp is in the closed position 72, the table top 10 looks like a uniform surface from the upper side.

The recess 30 includes a lower surface 34, and in the illustrated embodiments the recess 30 further comprises a front side 31, rear side 33, right side 36, and left side 38. In the closed position 72, the front side 31 of the recess 30 faces the front side 51 of the lamp 50; the right side 36 of the recess 30 faces the right side 56 of the lamp 50; and the left side 38 of the recess 30 faces the left side 58 of the lamp 50. In the illustrated embodiments, the rear side of the recess 30 is open, but in embodiments in which the recess 30 is enclosed by the table top, the rear side 53 of the lamp 50 will face a rear side of the recess 30. The recess 30 can further comprise other structural components for securely retaining the lamp 50 in the closed position 72, for example by means of a catch or other mating connector for a fastener such as the illustrated latch 55 on the distal end 59 of the lamp 50. Other mechanisms known in the art, such as a touch latch or catch and strike plate can also be used.

Figure 2:
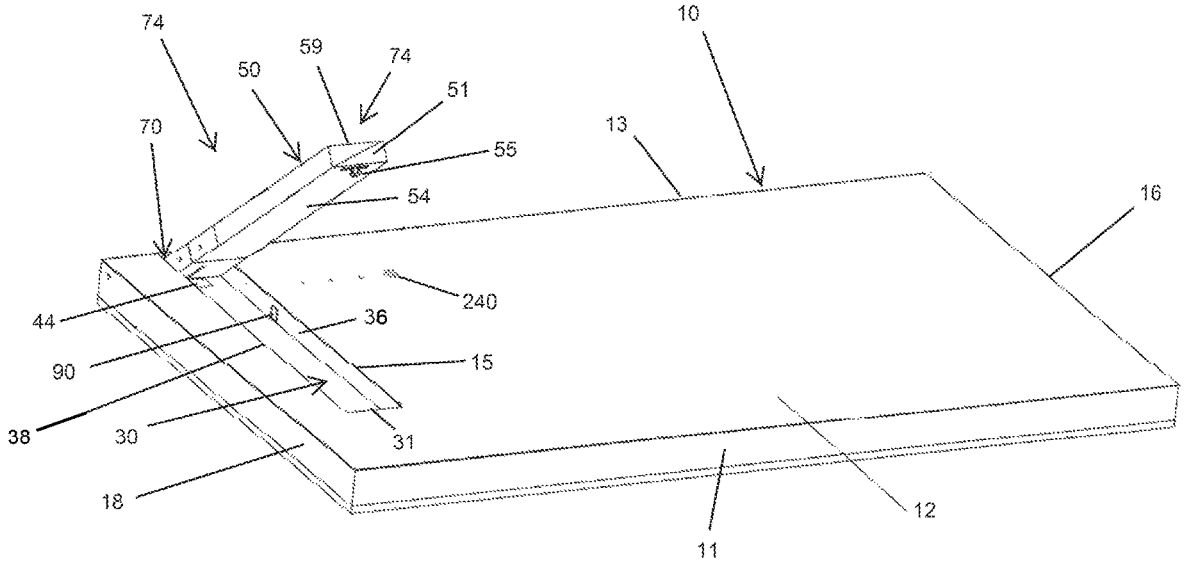
FIG. 2 is a top, right side perspective view of an embodiment of a table top of the present invention, showing the lamp in an open position.
Figure 3:
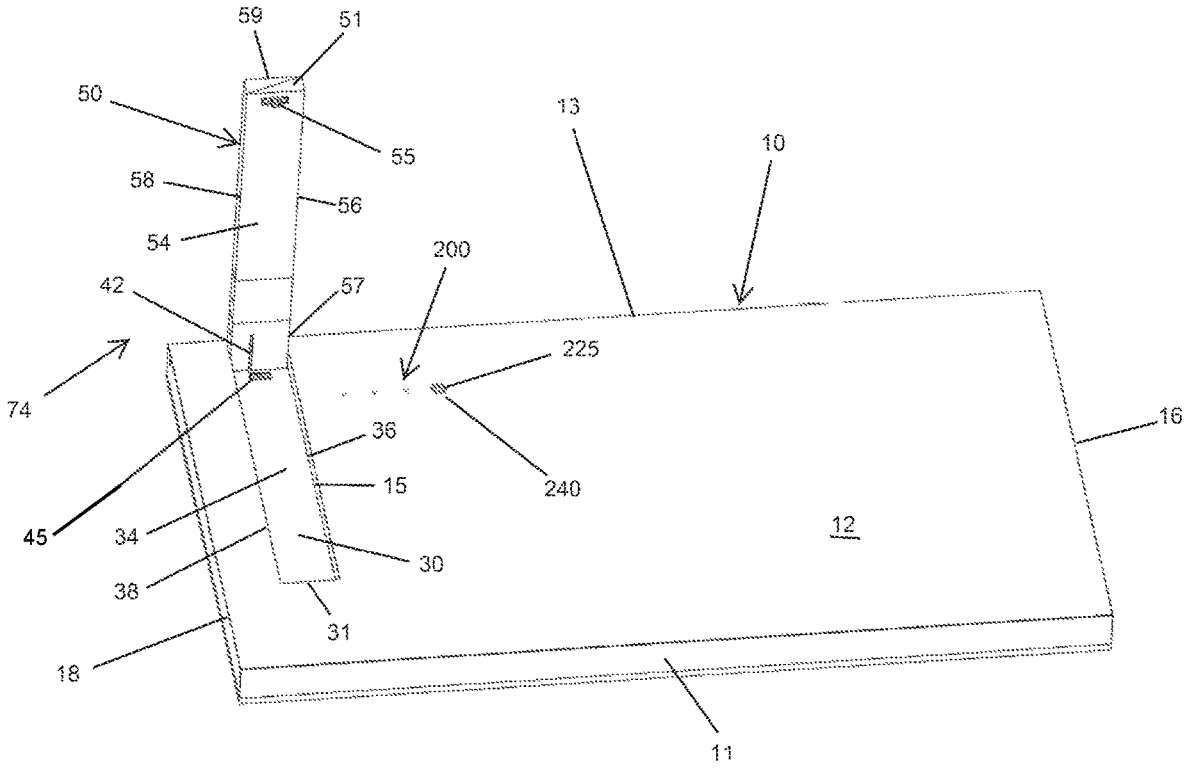
FIG. 3 is another top, right side perspective view of the table top of FIG. 2 with the lamp in an open position.

The proximal end 57 of the lamp 50 is connected to the table top 10 so that the free distal end 59 can be moved upwardly relative to the proximal end 57 in order to place the lamp 50 in an open position 74 in which the distal end 59 is above the planar upper surface 12 of the table top 10. Articulation of the lamp 50 in this way is preferably accomplished with a hinged connection so that the lamp 50 is thereby rotatable around the hinge between a closed position 72 as shown in FIG. 1 and an open position 74 as shown in FIGS. 2 and 3. In the illustrated embodiments, the lamp hinge 70 comprises a channel 73 for retaining a rod (not shown). The rod extends outside the channel 73 and is retained in corresponding channels (not shown) in the right side 36 and left side 38 of the recess 30. Other types of hinged connections known to the art can also be used.

Preferably, the lamp 50 includes a lift mechanism, so that when a user presses on the lamp 50 or otherwise actuates a predetermined mechanism, the distal end 59 of the lamp 50 is urged upwardly. For example, the proximal end 57 of the lamp 50 can include a spring hinge 40, in order to facilitate opening and closing of the lamp 50. The spring hinge 40 can comprise a spring 45, a first joining portion 42 which connects the hinge 40 to the table top 10, and a second joining portion 44 to connect the hinge 40 to the lamp 50. For example, the first joining portion 42 and second joining portion 44 can comprise the ends of a spring, such as a 180 degree torsion spring, or can be brackets mechanically connected to a spring of the hinge. The bracket of the first joining portion 42 can then be mechanically attached to the table top 10 and/or to the lower surface 34 of the recess 30 through screws or other fasteners, and the bracket of the second joining portion 44 can likewise be mechanically attached to the lamp 50.

Figure 4:
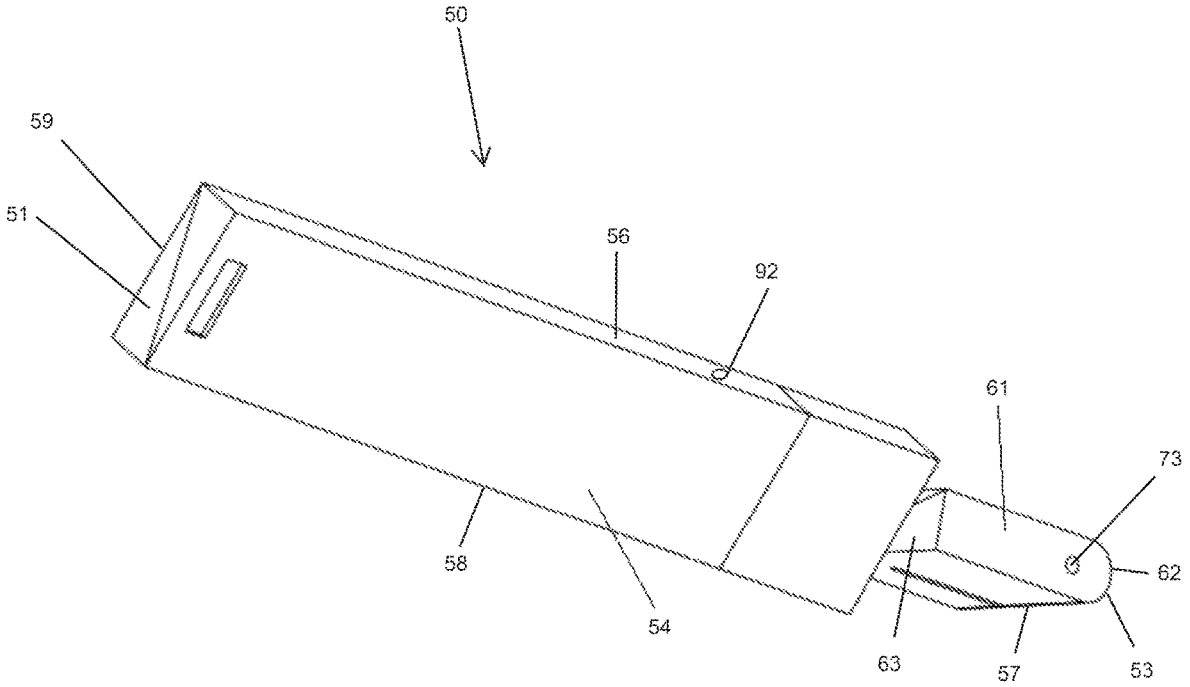
FIG. 4 is a bottom, right side perspective view of an embodiment of a lamp having two sections for use with the present table.

In one embodiment, the lamp 50 can comprise a proximal section 61 and a distal section 65 which are rotatable or otherwise movable with respect to each other to allow the light source 80 in the distal section 65 to rotate. The proximal section 61 has a proximal end 62 attached to the lamp hinge 70 and a distal end 63 attached to a proximal end 66 of the distal section 65. The distal section 65 further comprises a distal end 67, which is also the distal end 59 of the lamp 50. In the embodiment shown in FIGS. 4-6, the distal section 65 can be rotated with respect to the proximal section 61 around the longitudinal axis of the lamp 50. Such rotation is enabled by a rod or conduit 75 which extends through the proximal section 61 and the distal section 65 in order to mechanically connect the proximal section 61 to the distal section 65 and serve as an axis around which mechanical rotation of the proximal section 61 with respect to the distal section 65 is provided. The rod 75 is structurally strong enough to join the proximal section 61 to the distal section 65, and is also preferably hollow and serves as a conduit to allow concealed wires to run from the light source 80 in the distal section 65 to the proximal section 61 and then to an electrical source, in order to be able to place the light source 80 in electrical communication with a source of electricity. In one embodiment the rod 75 is a ½" aluminum rod. Preferably, the rod 75 includes a central channel to allow a wire or wires to pass therethrough, in order to place the light source 80 in communication with a source of electricity.

Figure 5:
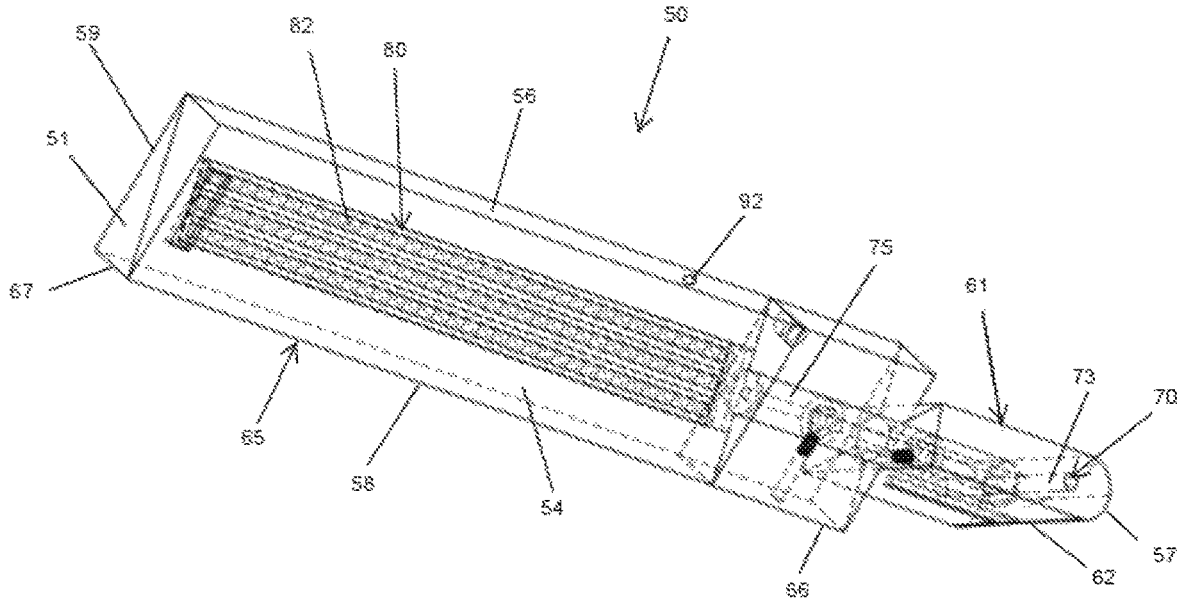
FIG. 5 is a bottom perspective view of the lamp of FIG. 4 showing its interior components.
Figure 5A:
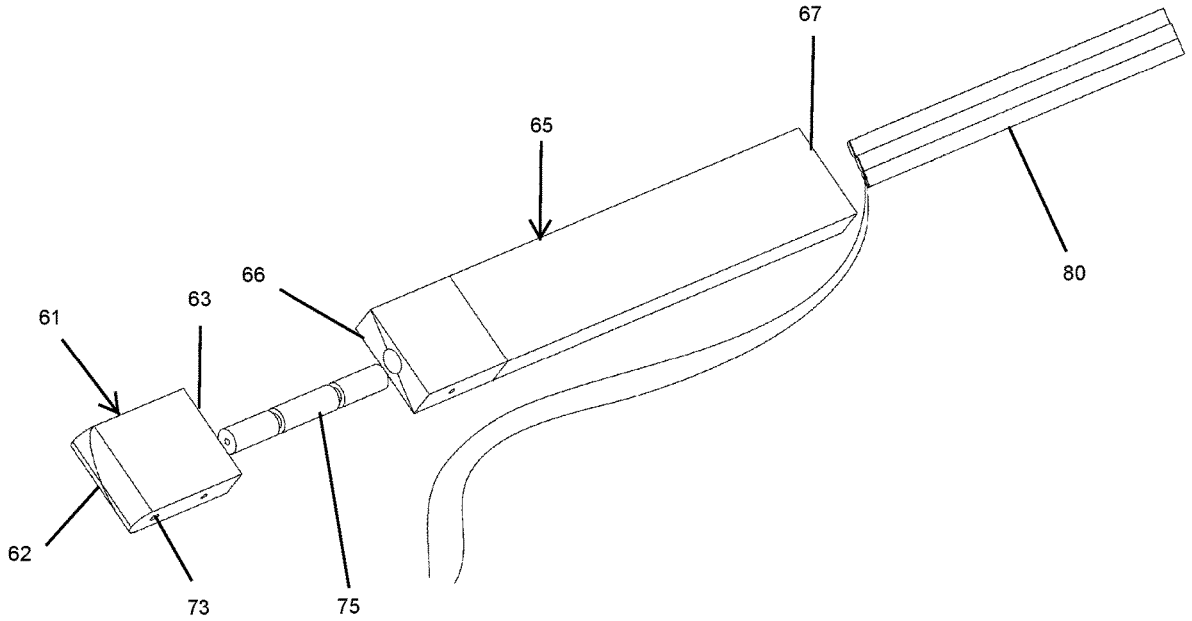
FIG. 5A is an exploded view of an embodiment of a lamp having two sections for use with the present table.
Figure 6:
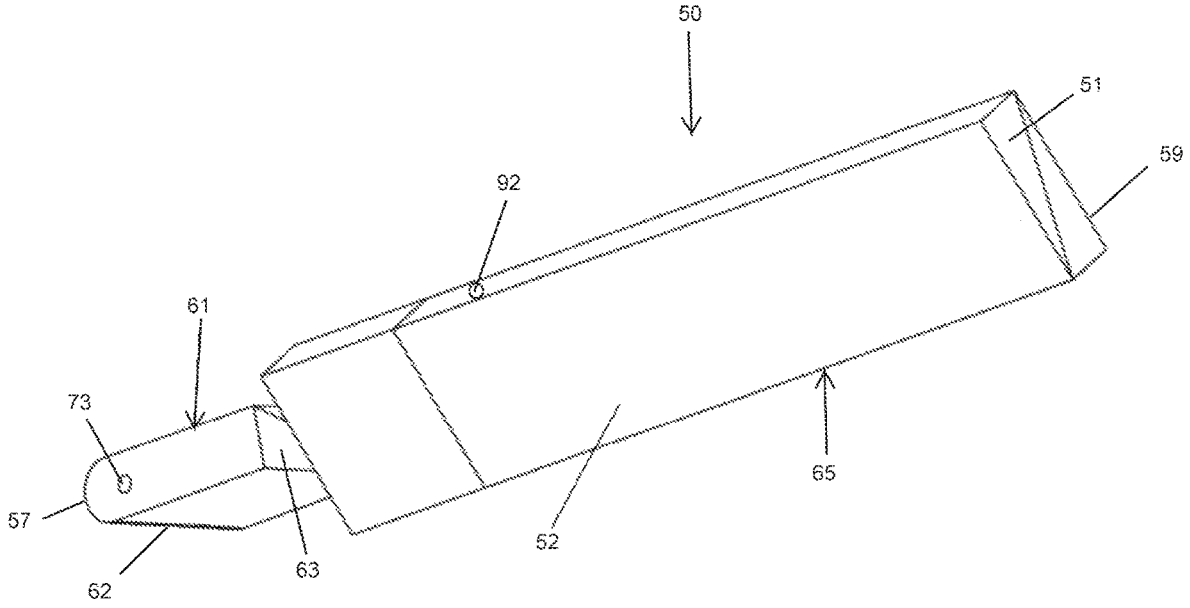
FIG. 6 is a top, left side perspective view of the lamp of FIG. 4.
Figure 6A:
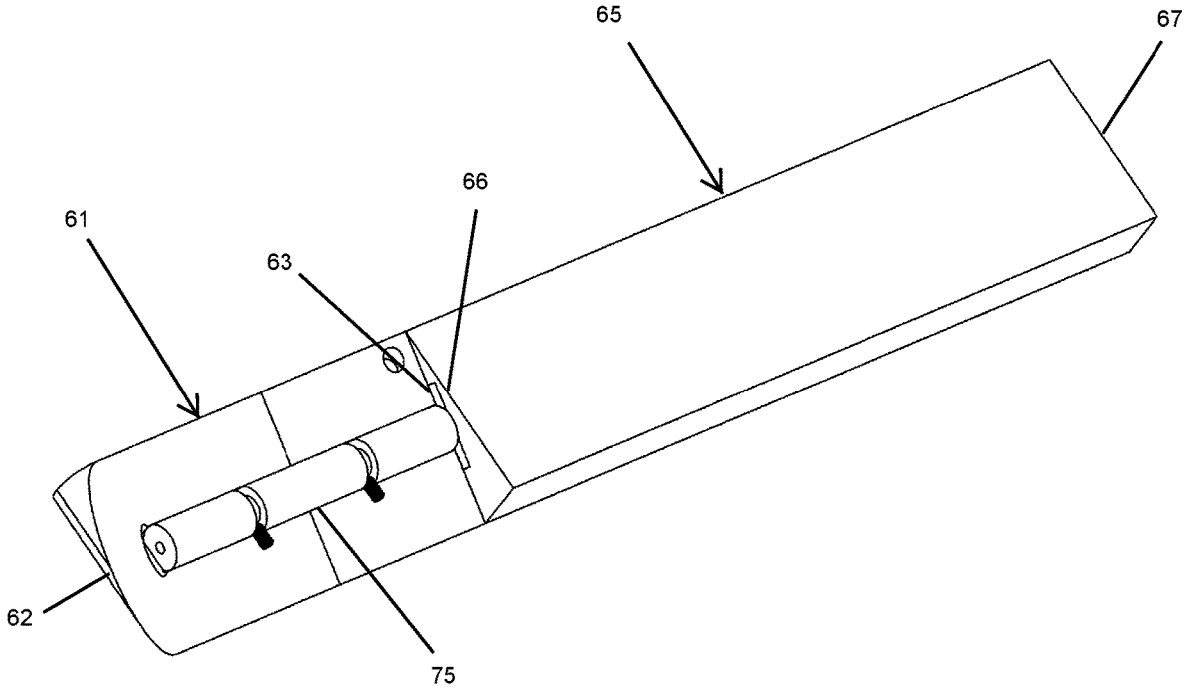
FIG. 6A is a top, perspective view of the embodiment of the lamp shown in FIG. 6 which shows a partial cutaway view of the proximal section and the proximal end of the distal section of the lamp.

The lamp 50 further comprises a light source 80 in order to provide light to the upper surface 12 of the table top 10. As best seen in FIG. 5, in a preferred embodiment the light source 80 can be an array or series of LED lights 82. Preferably, the LED lights 82 are retained in a chamber within the lamp 50, such as within the distal section 65, and the lamp 50 comprises a lower surface 54 which is transparent or translucent in order to allow light from the LED lights 82 to shine through it. The light source 80 can be located along the longitudinal extent of the lamp 50 in a variety of locations or lengths, but preferably is at least positioned in the distal end of the 59 of the lamp 50.

Preferably, the recess 30 further comprises a sensor for sensing when the lamp 50 is in a closed position 72 (FIG. 1) or open position 74 (FIG. 2). The position sensor (first sensor) 90 can be, for example, a Hall effect sensor, a Reed switch, or a dead man's switch. Preferably, there are hidden magnets 92 built into the right side 56 or left side 58 of the lamp 50 and a Hall effect sensor incorporated into the right side 36 or left side 38 of the recess 30 in the table top 10, with the magnet or magnets 92 and the sensor 90 being positioned adjacent to each other when the lamp 50 is in the closed position 72. The hidden magnets 92 are thereby lined up with the Hall effect sensor 90 such that they meet when the lamp 50 is in the closed position 72. The sensor 90 is in electrical communication with circuitry which turns off the lamp 50 when the lamp 50 is placed in the closed position 72. When the lamp is placed in the open position 74, the circuitry preferably turns the lamp 50 on, for example when magnets 92 separate from the Hall effect sensor in the illustrated embodiment. Placing the lamp 50 in the open position also preferably activates the indicator lights 280 in order to make indicia 225 of the embedded touch control 200 visible, as discussed further below.

Touch Controls

The lamp 50 is further preferably controlled in the present table 1 through the use of embedded touch controls 200 located beneath the planar upper surface 12 of the table top 10. The embedded touch control or controls 200 control the light level of the lamp 50, preferably through the use of capacitive touch sensors 220 positioned below the planar upper surface 12, through sensor circuitry 210 and control circuitry 215. The position of such touch sensors 220 is indicated by one or more lighted indicators 240 formed by LEDs 280 shining light through etched portions of the lower surface 14 of the table top 10.

In order to enable the use of such sensors 220, the planar upper surface 12 of the table should be made of a material that is not conductive (not metal, for instance) and is not transparent (such as glass or clear plastic). One example of an appropriate material is medium density fiberboard (MDF), which is a high grade composite material made from recycled wood fibers and resin. Other examples include painted solid laminate, wood veneer, opaque acrylic, and plastic. The planar upper surface 12 can be a veneer 20, for example (FIG. 5).

The embedded touch control 200 needs to be simultaneously touch-sensitive and back-lit through the planar upper surface 12. In order to provide a translucent area where light can pass and indicate the position of touch sensor 220, an area of the lower surface 14 of the table top 10 containing the touch controls 200 is provided with a reduced thickness, either by being formed in this manner during manufacture or by etching, i.e. removing material from the lower surface 14 in order to provide an area of reduced thickness 290. For example, the lower surface 14 can be etched with indicia (iconography or symbols) 225 to indicate the embedded touch control 200 that an indicator light 280 shines through to create the iconography. Preferably, the area around the iconography is painted with dark paint or other covering to prevent light from spilling through around the iconography, which would make it appear "blurry," in particular on the lower surface 24 of the veneer 20. The iconography preferably indicates a higher or lower light level of the lamp with recognizable indicia, such as a bar or bars of increasing length or thickness, or other shapes of increasing size, to indicate increasing light levels.

Figure 7:
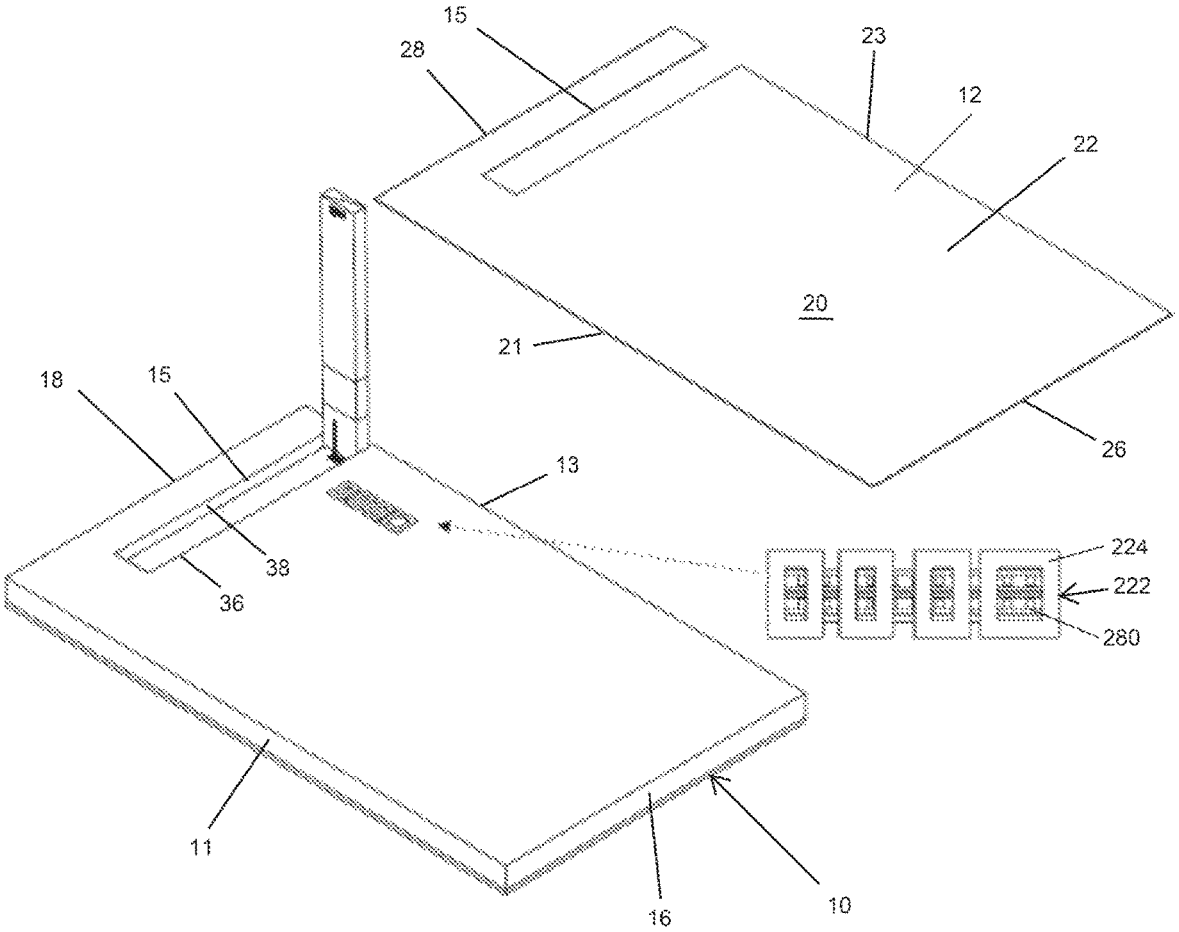
FIG. 7 is an exploded view of an embodiment of the table top of the present invention showing embedded touch controls and a veneer covering the planar upper surface of the table top.
Figure 7A:
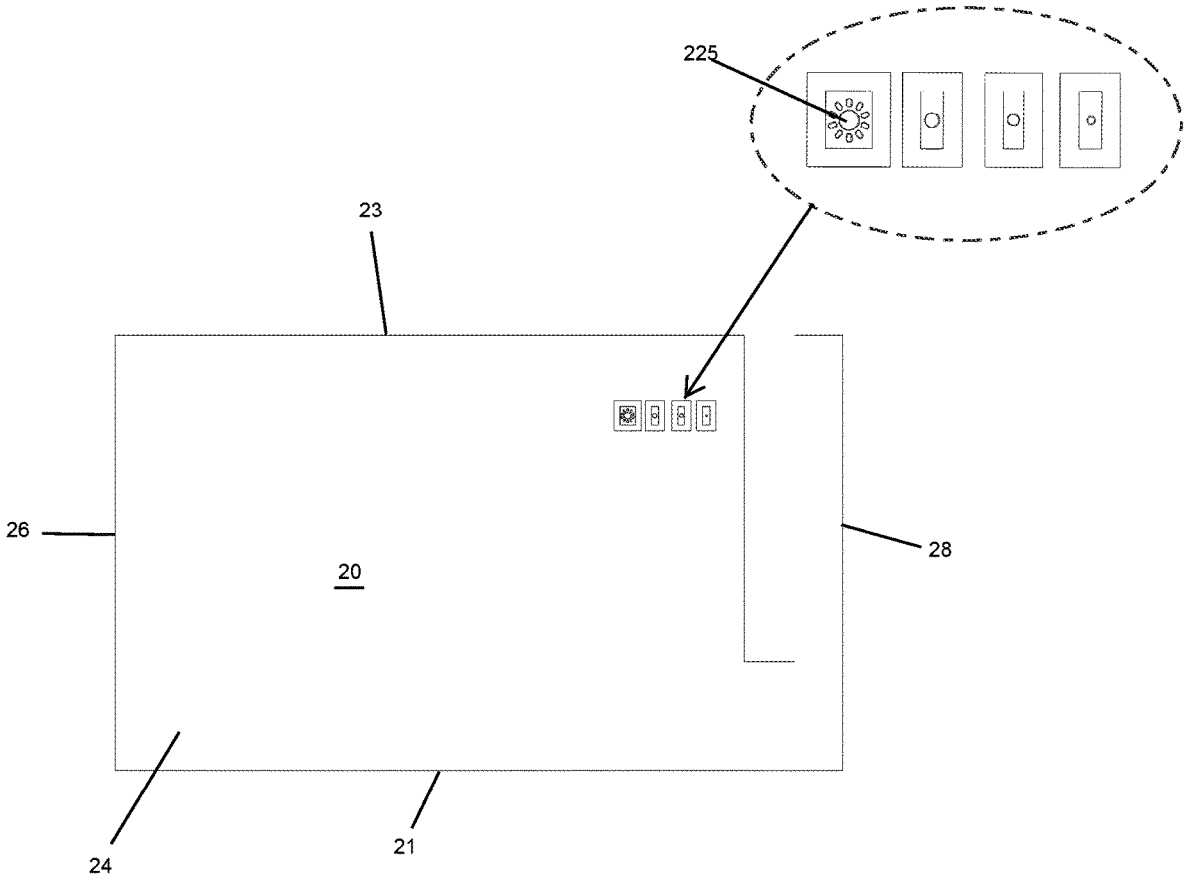
FIG. 7A shows the lower surface of a veneer for use with the present table top, showing indicia in the veneer.

Preferably, the lower surface 14 is etched or otherwise provided with a thickness which makes it translucent, and a conductive layer 222 is provided below this. As illustrated in FIG. 7A, for example, portions of the lower surface 24 of the veneer 20 can be etched or "rastered" to a depth which renders such etched portions 25 translucent when light is passed through them. The etched portions 25 are etched in a pattern so as to form the indicia 225 on the upper planar surface 12 of the table top 10 when light is shown through the etched portions 25. In this way, the indicia 225 can be visibly displayed on the upper surface 22 of the veneer 20 when light is directed upward from below the lower side 24 of the veneer 20.

The conductive layer 222 is typically metal, such as copper, and is preferably formed in a pattern which causes the iconography of the embedded touch control 200, i.e. the lighted indicator 240, to be produced when light is shined upwardly from below the conductive layer 222 through the area of reduced thickness 290. The area covered by the conductive layer 222 defines the area of the embedded touch control 200 which will be touch responsive. The touch sensitive area of the embedded touch control 200 is thus preferably made of three layers: (1) a portion of the planar upper surface 12 positioned over an area of reduced thickness 290, such as an area of reduced thickness on the lower surface 24 of the veneer 20, where the iconography of the lighted indicator 240 will appear; (2) below this, a thin layer of metal (copper or conductive material) that is patterned (e.g., a hollow square); and (3) below this, an indicator light 280 such as an LED light 282 capable of shining light upwardly through the area of reduced thickness 290.

When the area of reduced thickness 290 is produced by etching, it can be produced, for example, by a laser which creates the iconography of the embedded touch control. By etching with a laser, a part of the lower surface 14 can be cut into and made thinner. The depth of the etching is determined by a depth which allows the planar upper surface 12 to become translucent, and can be, for example, 0.1-1 millimeter, 0.2-5 millimeters, or 0.5-10 millimeters, depending on the material used in the table top 10. When the table top 10 is covered with a veneer 20, the part of the table top 10 below the veneer 20 where the embedded touch control 200 is located can be removed completely, and the etching can be conducted on the bottom side of the veneer 20. In this embodiment, a hole is thus cut in the structural portion of the table top 10, and the components of the embedded touch control 200 can be housed in the hole.

Figure 8:
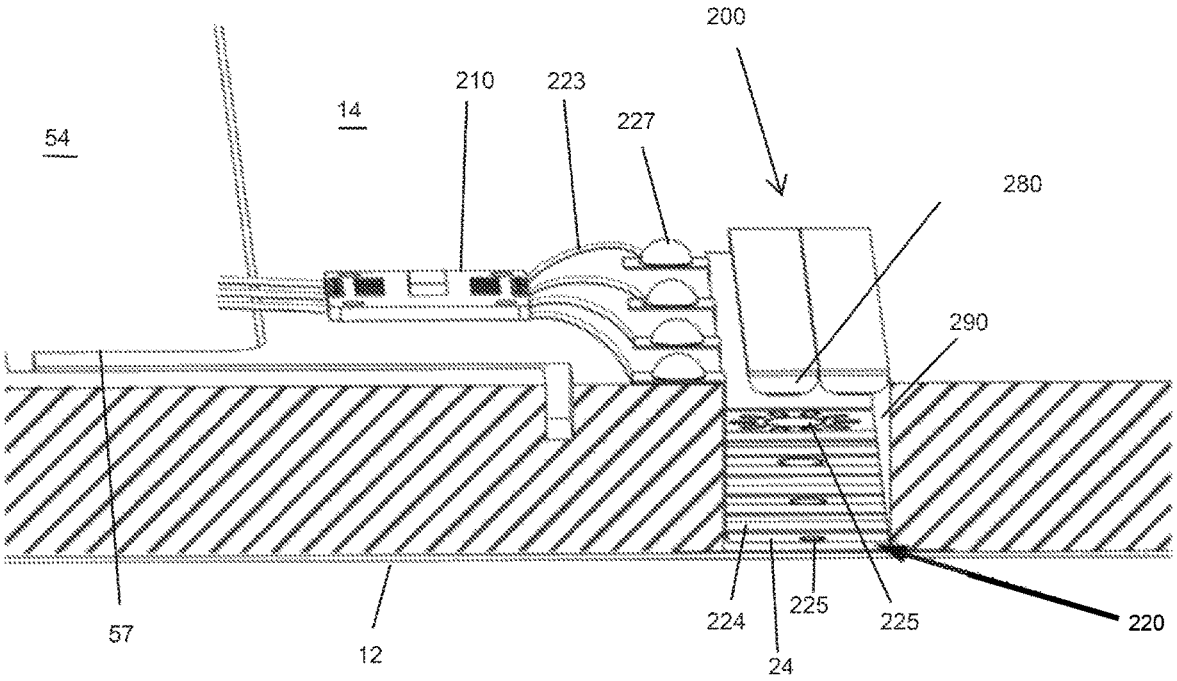
FIG. 8 shows a bottom, sectional view of an embedded touch control.
Figure 9:
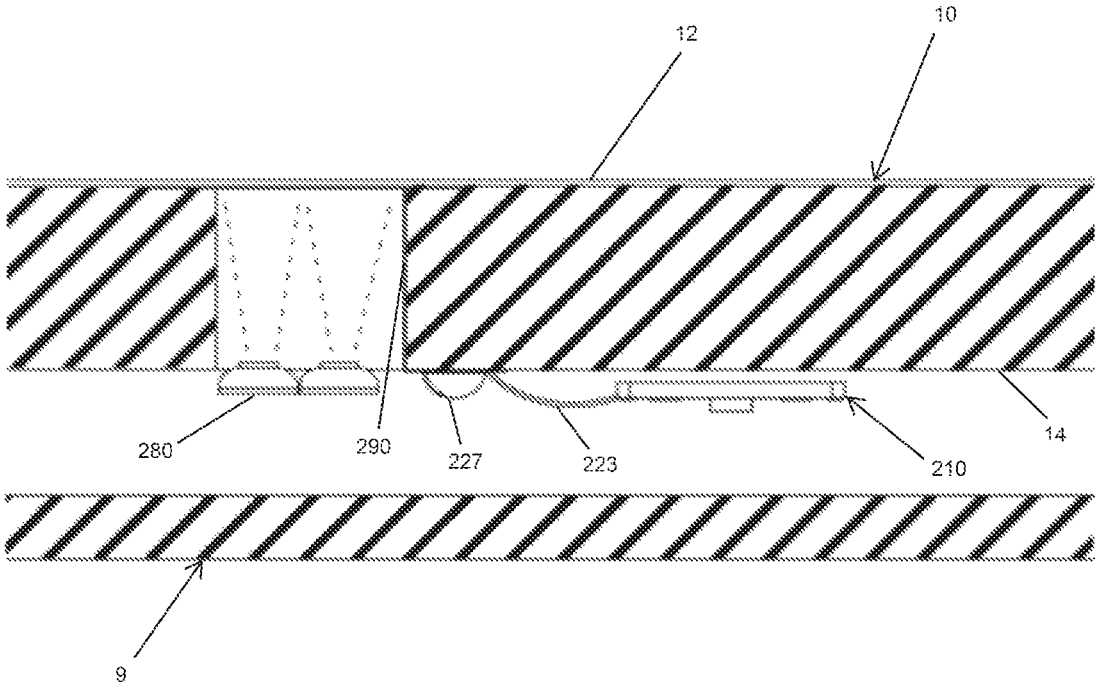
FIG. 9 is a sectional view of an embodiment of the embedded touch control.

The capacitive touch sensor 220 of the embedded touch control 200 is placed in the area of reduced thickness 290 beneath the planar upper surface 12. In one embodiment, the conductive layer 222 of the touch sensor 220 comprises a patterned metal layer 224. In one embodiment, best seen in FIG. 8, the touch sensor 220 comprises a patterned metal layer 224 in electrical communication with sensor wires 223 which place the metal layer in communication with sensor circuitry 210, with the wires 223 and metal layer 224 secured by sensor solder points 227. Since the conductive layer 222 is typically formed from an opaque material such as copper or other metals, it is important that the conductive layer 222 be formed between and/or around the area of the lower surface 14 of the table top 10 which comprises the indicia 225, so that the conductive layer 222 does not overlap the area which comprises the indicia 225. In this way, light from the indicator lights 280 can shine through the upper surface 12 of the table top 10. For example, the center of a metal layer forming the conductive layer 222 can be hollowed out to allow the light to shine through, in order for it to both be able to pass light through it and have enough conductive material to be able to detect capacitance where the icons appear. As shown in FIG. 9, the metal layer can alternatively be placed between the indicia.

As seen in FIG. 9, the sensor circuitry 210 and LEDs 282 are each in electrical communication with control circuitry 215, such as a microprocessor, which can be housed on a circuit board for example. The control circuitry 215 is further in electrical communication with the first sensor 90 and with the lamp via an electrical connector 217. When the position of the lamp 50 is changed from a closed position 72 to an open position 74, the circuit formed by sensor 90 is changed which is detected by control circuitry 215, which activates the indicator lights 280 (LEDs 282). The indicator lights 280 thereby shine light through the upper planar surface 12 to make the indicia 225 visible to a user. When the sensor circuitry 210 of the capacitive touch sensor 220 experiences a change in capacitance, such as due to the presence of a user's finger contacting the planar upper surface 12 above the conductive layer 222, the sensor circuitry 210 will provide a signal to the control circuitry 215 via electrical wires 260, and the control circuitry 215 will adjust the light level of the lamp 50 based on the portion of the conductive layer 222 which experienced a capacitance change. In order to protect the wires and circuitry, a cover 9 is preferably placed under them, i.e. beneath the portion of the lower surface 14 where the electrical components are located, so that the electrical components are between the cover 9 and the lower surface 14.

Since the indicator light 280 comprises metal and is thus conductive, if it sits too close to the metal layer 224, the metal from the indicator light 280 or from the metal in the wires could potentially trigger the sensor circuitry 210 to detect a signal. This can be prevented by spacing the indicator light and associated wires apart from the conductive layer 222, such as by positioning the indicator lights 280 a predetermined distance below the conductive layer 222, which in one embodiment can be ¾". This arrangement has the further benefit of providing "back lighting" to the area of reduced thickness 290.

Figure 10:
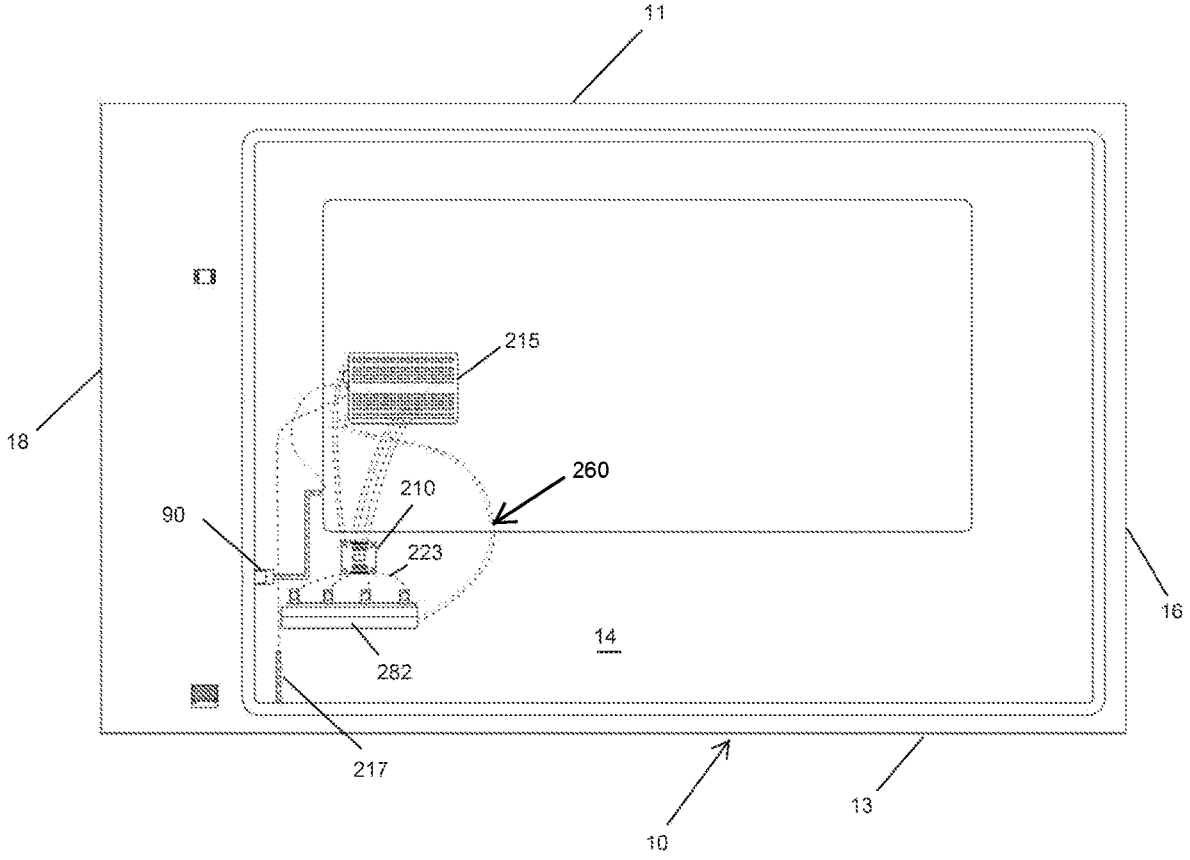
FIG. 10 is a bottom plan view of an embodiment of the present table top.
Figure 10A:
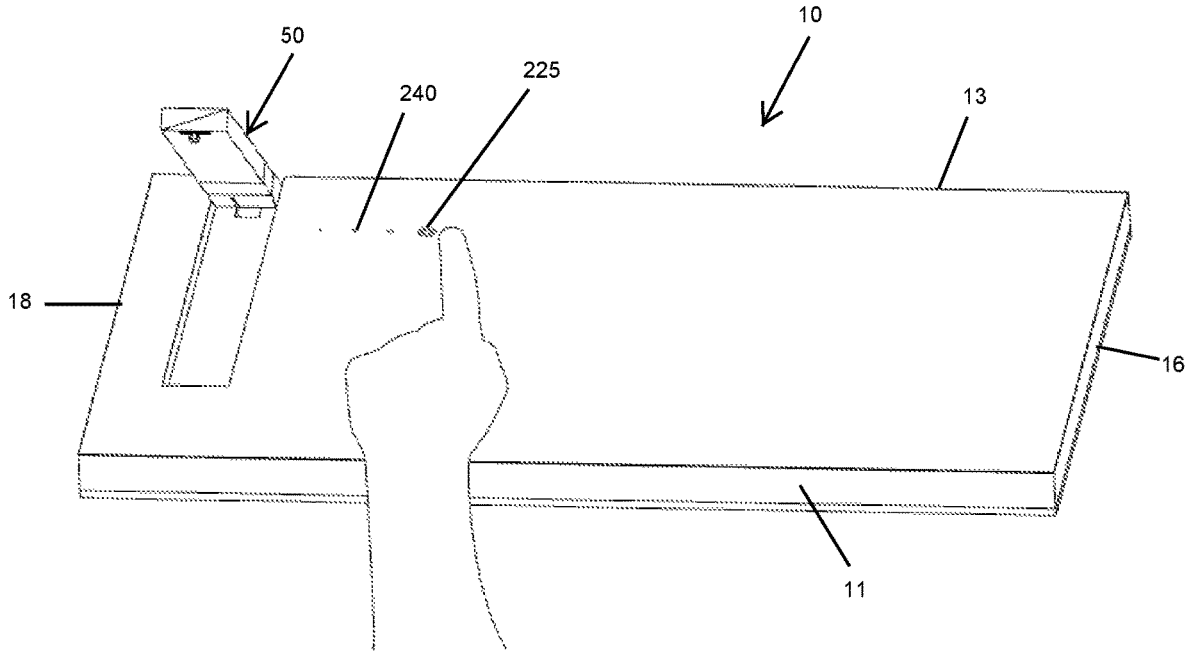
FIG. 10A is a top, left side perspective view of the table top of FIG. 1, showing a user's hand operating lighted touch controls with the attached lamp in an open position.

From the user's perspective, the indicator light, when activated, will shine up through the area outlined by the area of reduced thickness 290 and conductive layer 222 and through the planar upper surface 12 to create a glowing icon (indicia 225) on the upper surface 12 of the table top 10. As illustrated in FIG. 10A, when a user's finger 2 touches an illuminated icon 225, there is a change in the capacitance in the conductive layer 222 just beneath that area of the upper surface 12, which the sensor circuitry 210 detects and sends a signal to the control circuitry 215. That information can be used to then trigger an action based on what icon was activated by the user, such as increasing or decreasing the light level (brightness) of the lamp. The user sees icons illuminated on the table top upon lifting the task light and, as illustrated in FIG. 10A, the user can change the brightness of the lamp 50 by dragging a finger along the area where these controls appear.

In a preferred embodiment, illustrated in FIGS. 7A and 10A, the indicia 225 can correspond to increasing and decreasing levels of light emitted by the lamp. In the illustrated example, smaller indicia 226 can be used to represent a lower light level, and touching the upper planar surface at that point can cause a lower amount of light to be emitted by the lamp. Touching a larger indicia 227 spaced apart from indicia 226 can correspondingly be adapted to cause a higher amount of light to be emitted by the lamp, and sensors positioned between smaller indicia 226 and larger indicia 227 can be adapted to cause an intermediate level of light to be emitted by the lamp.

One of the most important aspects of the present table 1 is the ability for the lighted indicator controls 240 to appear and disappear through user interaction. When the lamp 50 is not in use, the table top 10 will have the appearance of a traditional desk, since the planar upper surface 12 where the indicia 225 appear looks the same as other portions of the upper surface 12 when the indicator lights 280 are off. Upon raising and lowering the lamp, the first sensor 90 sends its signal to the control circuitry 215, which then either turns on or off the lamp, based on whether the lamp is in the closed position 72 (when the lamp 50 is off) or open position 74 (when the lamp 50 is on). When the control circuitry 215 detects that the lamp is in the open position 74, it preferably turns on the lamp at a predetermined light level and also turns on the indicator light 280, so that the indicia 225 become visible. When the first sensor 90 detects that the lamp is in the closed position 72 (down), it turns off both the lamp 50 and the indicator light 280 and ignores any further input from the embedded touch control 200. The system preferably plugs into a standard wall outlet and an AC-to-DC converter converts the electricity to DC which then powers the LEDs and circuitry.

Figure 11:
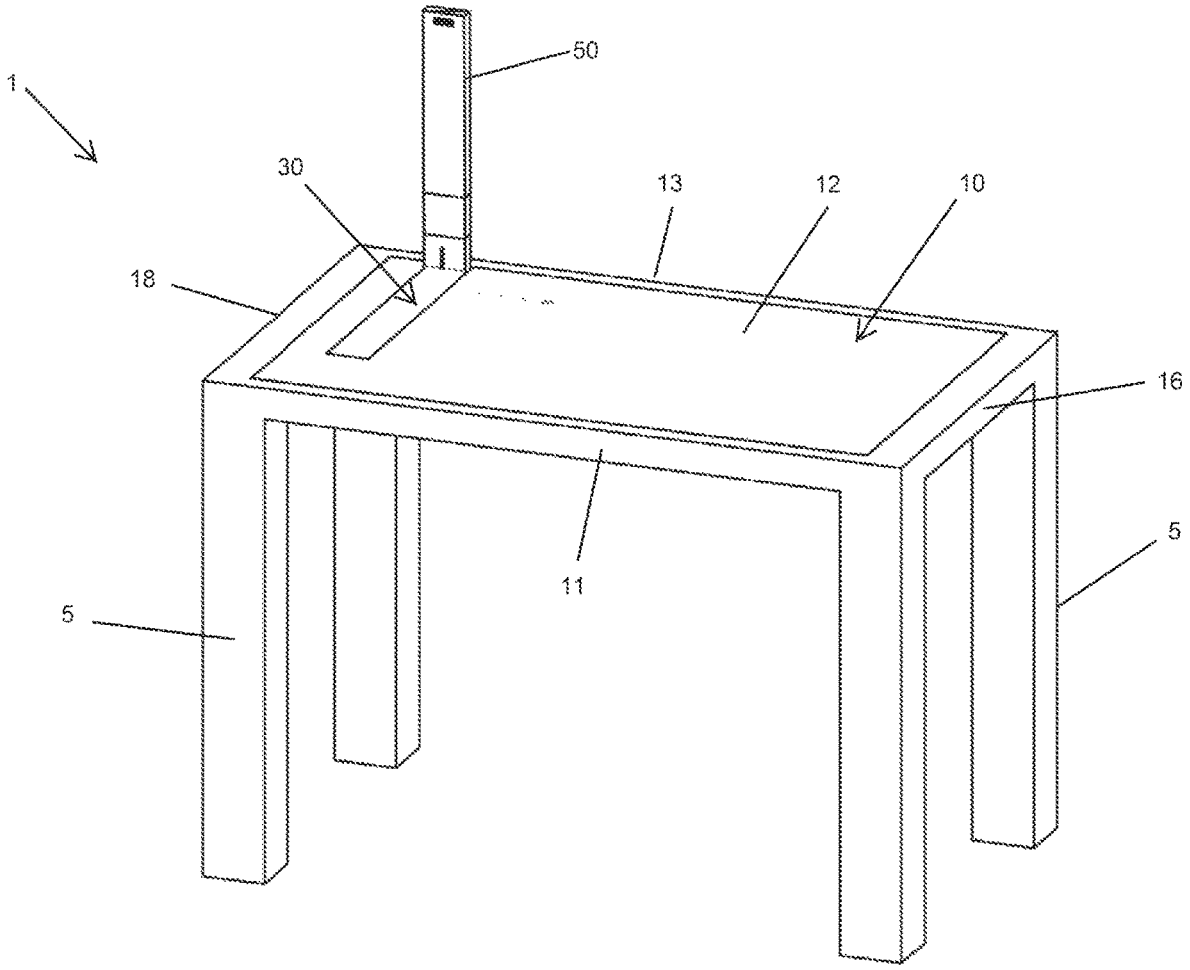
FIG. 11 is a left side, perspective view of an embodiment of the present table with a single lamp.
Figure 12:
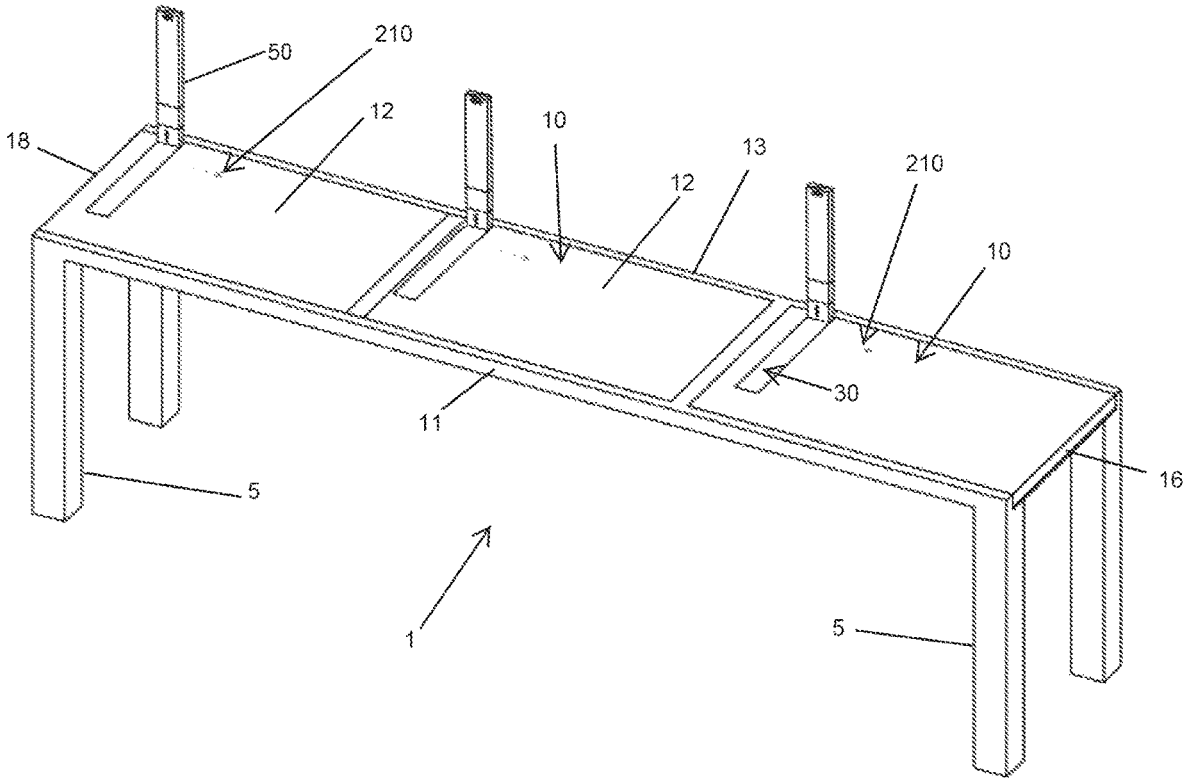
FIG. 12 is a left side, perspective view of an embodiment of the present table with multiple lamps.

As shown in FIGS. 11 and 12, the table top 10 can be incorporated into tables 1 having different configurations. FIG. 11 illustrates a conventional desk having four vertical legs or supports 5. It is to be understood however that other supports 5 known to the art can also be used, including supports which extend at a non-vertical angle between the table top 1 and a support surface below the table 1. Different numbers of supports can also be used, such as 1, 3, or more than four supports. FIG. 12 illustrates an embodiment in which a plurality of table tops 10 are incorporated in a modular fashion into a piece of furniture, which could be used for example in a library or school setting.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure.

Recitation of value ranges herein is merely intended to serve as a shorthand method for referring individually to each separate value falling within the range. Unless otherwise indicated herein, each individual value is incorporated into the specification as if it were individually recited herein. All references cited herein are incorporated by reference in their entirety.

What is claimed is:

1. A table comprising a table top, the table top having a planar upper surface and a lower surface, wherein the table top comprises:

a recess in the planar upper surface;

a lamp positioned in the recess, the lamp having an upper surface, a lower surface, a proximal end, and a distal end, wherein the proximal end of the lamp is connected to the table top and can be articulated between a closed position and an open position, wherein in the closed position the upper surface of the lamp is co-planar with the planar upper surface of the table top and in the open position the upper surface of the lamp is disposed at an angle with respect to the planar upper surface of the table top, wherein the lamp comprises a light source which is able to emit light when placed in communication with a source of electricity;

a first sensor that detects whether the lamp is in the open position or in the closed position, the first sensor being in communication with the recess;

an embedded touch control beneath the planar upper surface of the table top for controlling the light level of the lamp, the touch control comprising a capacitive touch sensor having a conductive layer and an indicator light, the indicator light being positioned beneath and spaced apart from the conductive layer of the touch sensor and able to emit light when the indicator light is activated; and control circuitry in electrical communication with the first sensor, the touch control, and the lamp, wherein the control circuitry controls a light level of the lamp in response to a signal received from the touch sensor, wherein the control circuitry receives a signal from the sensor when the lamp is articulated to the open position and when the lamp is articulated to the closed position, wherein light from the indicator light is able to pass through a translucent portion of the planar upper surface above the touch control and form indicia, the indicia not being visible on the surface when the indicator light is not activated, and wherein when the lamp is placed in the open position and the signal is sent from the sensor to the control circuitry, the indicator light is activated and emits light, and when the lamp is placed in the closed position and the signal is sent from the sensor to the control circuitry, the indicator light is not activated and does not emit light, and wherein when the lamp is placed in the open position and the signal is sent from the sensor to the control circuitry, the lamp is turned on and emits light, and when the lamp is placed in the closed position and the signal is sent from the sensor to the control circuitry, the lamp is turned off and does not emit light.

2. The table of claim 1, wherein the touch control activates and deactivates the lamp.

3. The table of claim 1, wherein the touch control changes a light level of the lamp.

4. The table of claim 1, wherein the lamp comprises a proximal section and a distal section, and wherein the distal section of the lamp is rotatable with respect to the proximal section.

5. The table of claim 1, wherein the first sensor is a Hall effect sensor, a Reed switch, or a dead man's switch.

6. The table of claim 1, wherein the planar upper surface is a veneer.

7. The table of claim 1, wherein the table top comprises a material selected from the group consisting of medium density fiberboard, solid laminate, wood veneer, opaque acrylic, and plastic.

8. The table of claim 1, wherein the translucent portion of the planar upper surface is formed by etching a portion of the lower surface of the table top.

9. The table of claim 1, wherein the embedded touch control is located below a portion of the table top in which the lower surface of the table top is separated from the planar upper surface by a depth of between 0.1 millimeter and 1 millimeter.

10. The table of claim 9, wherein the embedded touch control is located below a portion of the table top in which the lower surface of the table top is separated from the planar upper surface by a depth of between 0.2 millimeter and 5 millimeters.

11. The table of claim 10, wherein the embedded touch control is located below a portion of the table top in which the lower surface of the table top is separated from the planar upper surface by a depth of between 0.5 millimeter and 10 millimeters.

12. The table of claim 1, wherein the conductive layer is a metal layer.

13. The table of claim 1, wherein the indicator light comprises one or more LEDs.

14. The table of claim 1, wherein the table has one or more supports for the table top.

15. The table of claim 14, wherein the one or more supports comprise vertically extending legs.

16. The table of claim 15, wherein the table has four legs.

17. The table of claim 1, wherein the table comprises a plurality of lamps.

18. The table of claim 1, wherein the first sensor is located on the recess, on the lamp, or on both the lamp and the recess.

19. The table of claim 1, wherein the proximal end of the lamp is hingedly connected to the table top with a hinge, the lamp being rotatable around the hinge between a closed position and an open position.

* * * * *